United States Patent [19]

Siems et al.

[11] Patent Number: 5,060,664

[45] Date of Patent: Oct. 29, 1991

[54] METHOD OF AND APPARATUS FOR MAKING STREAMS CONTAINING FIBROUS MATERIALS OF THE TOBACCO PROCESSING INDUSTRY

[75] Inventors: Wolfgang Siems, Hamburg, Fed. Rep. of Germany; Andrzej Radzio, Quinton, Va.

[73] Assignee: Körber AG, Hamburg, Fed. Rep. of Germany

[21] Appl. No.: 137,512

[22] Filed: Dec. 23, 1987

Related U.S. Application Data

[63] Continuation-in-part of Ser. No. 53,176, May 21, 1987, abandoned.

[30] Foreign Application Priority Data

Nov. 28, 1986 [DE] Fed. Rep. of Germany ..... 3640730

[51] Int. Cl.[5] ..... A24C 5/18

[52] U.S. Cl. ..... 131/84.1; 131/905; 131/906

[58] Field of Search ..... 131/84.1, 905, 906; 493/41

[56] References Cited

U.S. PATENT DOCUMENTS 4,511,420 4/1985 Arthur ..... 131/84.1

FOREIGN PATENT DOCUMENTS 1422991 1/1976 United Kingdom .
1451119 9/1976 United Kingdom .
2068600 8/1981 United Kingdom .

*Primary Examiner*—V. Millin
*Assistant Examiner*—Joe H. Cheng
*Attorney, Agent, or Firm*—Peter K. Kontler

[57] ABSTRACT

A stream of filter tow which has been sprayed with atomized plasticizer is advanced past two detectors each of which monitors the density of the stream in a different way and generates corresponding signals which are processed by an evaluating circuit to generate modified signals which are indicative of the percentage of plasticizer. The modified signals are used to regulate the operation of a pump which controls the rate of admission of plasticizer to successive increments of the tow.

29 Claims, 3 Drawing Sheets

METHOD OF AND APPARATUS FOR MAKING STREAMS CONTAINING FIBROUS MATERIALS OF THE TOBACCO PROCESSING INDUSTRY

CROSS-REFERENCE TO RELATED CASES

This is a continuation-in-part of the copending patent application Ser. No. 053,176 filed May 21, 1987, now abandoned, for "Method of and apparatus for making streams containing fibrous materials of the tobacco processing industry".

A somewhat similar apparatus is disclosed in the commonly owned copending patent application Ser. No. 837,096 of Radzio.

BACKGROUND OF THE INVENTION

The invention relates to methods and apparatus for making rod-like products of the tobacco processing industry, such as filter rod sections or plain cigars, cigarillos or cigarettes of unit length or multiple unit length.

It is often necessary to form a rod-like filler of tobacco or filter material which contains a fibrous material (such as tobacco or filter tow) and one or more additional materials (such as water in the case of a tobacco filler and a suitable plasticizer in the case of a filler for the making of filter rod sections). Referring to the making of filter rod sections which can be united with plain cigarettes to form filter cigarettes of unit length or multiple unit length, it is customary to contact a running tow of filamentary filter material with a spray of atomized plasticizer (such as triacetin) which bonds spaced-apart portions of filaments in the tow to each other to thus establish a maze of paths for tobacco smoke. It is desirable and advantageous to ascertain the percentage of plasticizer in the tow because this enables the manufacturer to regulate the quantity of plasticizer and to thus determine the resistance which a filter plug offers to the flow of tobacco smoke into the mouth.

Presently known machines for the making of filter rod sections do not embody any means for rapidly, reliably and accurately ascertaining the percentage of plasticizer in the stream of fibrous material which is draped in a web of wrapping material and is converted into filter rod sections of desired (unit or multiple unit) length. One of the reasons for the absence of suitable means for reliably ascertaining the percentage of plasticizer in the filler of a rod which is about to be subdivided into filter rod sections, or the percentage of plasticizer in the filter rod sections, is that the chemical composition of the plasticizer is somewhat related to the composition of the material of the tow and, therefore, presently used monitoring or detecting apparatus cannot adequately and reliably distinguish between the percentages of filter tow material and plasticizer material in the filter rod or in the sections of a filter rod.

Commonly owned U.S. Pat. No. 3,865,016 to Greve discloses a method of producing filter rod sections and of monitoring the quantity of plasticizer in the filler of the filter rod. This patent proposes to remove from the filter rod making machine a certain number of filter rod sections which contain plasticizer and to produce the same number of filter rod sections without any plasticizer therein. The two groups of filter rod sections (with and without plasticizer) are weighed to allow for a determination of the percentage of plasticizer in the respective group of filter rods. In order to produce filter rod sections without plasticizer, it is necessary to temporarily turn off the unit which sprays plasticizer onto the running tow of filamentary filter material, i.e., to interrupt the normal operation of the machine. Thus, each sampling of the percentage of plasticizer in the filter rod sections involves a prolonged interruption of regular operation with attendant huge losses in output. Therefore, such sampling of the percentage of plasticizer is carried out only at infrequent intervals.

Another proposal is disclosed in British Pat. No. 2,120,075 which describes a nuclear magnetic resonance measuring device as a means for ascertaining the percentage of plasticizer in filter rod sections. Such measurement requires a relatively long interval of time during which the article to be tested is immobilized at the testing station. Thus, this proposal also involves an interruption of normal operation of a filter rod making machine and, therefore, its utilization is confined to removal of samples at spaced-apart intervals in order to avoid substantial losses in output which are attributable to a pronounced slowdown during monitoring of a portion of the filter rod or during monitoring of discrete filter rod sections.

Determination of the percentage of plasticizer in a continuous filter rod or in discrete sections of a subdivided filter rod constitutes but one of the tasks which still await an optimum or a highly satisfactory solution in the tobacco processing industry. The situation is somewhat analogous in connection with the determination of moisture content of tobacco in a rod-like filler which is converted into a tobacco rod or into discrete plain cigarettes or other rod-shaped tobacco-containing articles.

Thus, there exists an urgent need for a method and for an apparatus which can be resorted to in order to rapidly, reliably and accurately determine the percentage of different materials in a stream or rod of tobacco or filter material and/or in discrete sections of a tobacco or filter rod without necessitating a prolonged or any slowdown or stoppage of the machine or the production line which turns out such articles. This applies in particular for the measurement of percentages of plasticizer in an unwrapped or wrapped filter rod or in sections of a filter rod as well as for the measurement of moisture content of a draped tobacco filler (e.g., the filler of a cigarette rod which is about to be subdivided into plain cigarettes of unit length) and for the measurement of moisture content of discrete rod-shaped articles which are obtained as a result of subdivision of a draped tobacco filler.

OBJECTS AND SUMMARY OF THE INVENTION

An object of the invention is to provide a novel and improved method of making a stream of fibrous and other materials wherein the percentages of various constituents can be determined in a simple, effective and reliable way without interrupting the normal mode of operation.

Another object of the invention is to provide a method which can be used to ascertain the percentage of plasticizer in a filter rod which is to yield filter rod sections of desired length.

A further object of the invention is to provide a method which can be used to ascertain the moisture content of continuous rods of filter material and/or tobacco even if the liquid or liquefiable medium in the rods is such that it cannot be readily distinguished from other ingredients of the rods.

An additional object of the invention is to provide a filter rod making or a cigarette making machine with an apparatus which can ascertain the percentage of plasticizer or water while the machine is operated at full speed.

Still another object of the invention is to provide a method which renders it possible to continuously and automatically maintain the percentages of various ingredients of filter rods or cigarette rods within a desired range and to provide a novel and improved apparatus for the practice of such method.

An additional object of the invention is to provide a method which can be used to ascertain the percentages of various constituents in a continuous rod or in successive or selected sections of a subdivided rod.

A further object of the invention is to provide a cigarette rod making machine which embodies the above outlined apparatus and to provide a filter rod making machine which embodies the above outlined apparatus.

Another object of the invention is to provide a method which can be practiced with a simple apparatus and which ensures a highly accurate determination of the percentages of various ingredients in a cigarette rod or filter rod.

One feature of the present invention resides in the provision of a method of making rod-like products of the tobacco processing industry. The method comprises the steps of forming a composite stream containing a fibrous material (such as (a) fragments of natural tobacco leaves, reconstituted tobacco and/or artificial tobacco or (b) a tow of filamentary filter material) and a second material (such as a plasticizer or water), conveying the stream along a predetermined path which can extend toward and beyond a station where the stream is draped into a web of wrapping material and toward and beyond a station where the resulting rod is subdivided into rod-like sections of unit length or multiple unit length, and measuring the density of successive increments of the stream including directing radiation across the stream in at least one portion of the path, monitoring the characteristics of radiation which has penetrated through the stream and generating first signals which denote the monitored characteristics. The method further comprises the step of processing the first signals so as to ascertain the quantity (e.g., percentage) of at least one of the materials in the stream (e.g., to ascertain the percentage of plasticizer or water per unit length of the stream).

The measuring step can further comprise determining the density of successive increments of the stream in at least one additional portion of the path and generating additional signals which denote the thus determined density. The processing step can comprise converting the first and the corresponding additional signals into modified signals which denote the quantity of one of the materials in the stream. The modified signals can be indicative of the differences between the intensities and/or other characteristics of the first and the corresponding additional signals.

The second material is or can contain a liquid, such as water or the aforementioned plasticizer.

The method can further comprise the step of utilizing the processed signals to regulate the quantity of at least one of the materials in the stream so as to maintain the percentage of the one material within a predetermined range, e.g., at a fixed value.

The radiation can be corpuscular radiation, light (particularly infrared light) or X-rays.

The method can further comprise the step of subdividing the stream into sections of predetermined length (particularly subsequent to draping of the stream into a web of cigarette paper or other suitable wrapping material) in a second portion of the path upstream of the locus of at least one measurement of the stream i.e., the measurement can involve monitoring the quantity of one of the materials in discrete sections of the stream.

The measuring step can include weighing at least some of the sections which are obtained as a result of subdivision of the stream and generating signals which are indicative of the weight of such sections. These signals can be used in lieu of signals which are generated by a detector operating with a source of corpuscular radiation.

If the second material is a plasticizer, the measuring step preferably further comprises a second determination of the quantity of plasticizer in the stream and the generation of different additional signals denoting such quantity. The processing step then includes comparing the first and the additional signals and generating a modified signal denoting the quantity of plasticizer in the stream. Such modified signal can be used to regulate the quantity of plasticizer if the monitored quantity deviates from an optimum value.

If the second material is water, the measuring step can further comprise a second determination of the quantity of water in the stream and the generation of different additional signals which denote such quantity. The processing step then comprises comparing the first and additional signals and generating a modified signal which denotes the quantity of water in the stream.

The processing step can include ascertaining the dry weight of the fibrous material, and such method can further comprise the step of regulating the dry weight of fibrous material as a function of the intensities and/or other characteristics of signals denoting the measured density.

The measuring step can comprise determining the density of successive increments of the stream in at least one additional portion of the path and generating additional signals denoting the thus determined density. The processing step of such method can comprise converting the first named and the corresponding second signals into reference signals which denote the quantity (particularly the dry weight) of fibrous material in the stream, and such method can further comprise the step of regulating the quantity of fibrous material in the stream as a function of the reference signals.

Another feature of the present invention resides in the provision of an apparatus for making rod-like products of the tobacco processing industry. The apparatus comprises means for forming a composite stream which contains fibrous material (such as tobacco or a tow of filamentary filter material) and a second material (such as water or plasticizer), means for conveying the stream along a predetermined path (which, as mentioned above, can extend through and beyond a wrapping and severing station), means for measuring the density of the stream including means for generating first signals which denote the density, and means for processing the signals in order to ascertain the quantity of at least one of the materials in the stream. The measuring means can comprise a plurality of detectors each of which is responsive to the presence of at least one material in the stream in a different way and each of which generates different signals denoting the density of the stream. The processing means then comprises means for evaluating signals which are generated by the detectors, and the evaluating means can comprise means for generating modified signals denoting the differences between the signals which are generated by the detectors.

The forming means can include adjustable means for influencing the quantity of at least one of the materials in the stream (such influencing means can comprise a pump which causes a spray of plasticizer to be distributed on successive increments of a running tow of filamentary filter material, a device which admits water to a stream of tobacco particles or a device which dries the particles of the stream in order to reduce the percentage of water therein), and the apparatus which embodies such influencing means can further comprise means for adjusting the influencing means in response to modified signals so as to maintain the percentage of the one material in the stream within a predetermined range (e.g., at a fixed value).

One of the detectors can include means for directing a beam of corpuscular radiation across the stream in a predetermined portion of the path, and the signal generating means can include means for monitoring the characteristics (e.g., the intensity) of radiation which has penetrated across the stream. Another detector can include means for directing a beam of light (particularly infrared light) across the stream in a predetermined portion of the path (e.g., adjacent the locus of penetration of corpuscular radiation), and the signal generating means then further includes means for monitoring the characteristics (such as the intensity) of light which has penetrated across the stream.

The apparatus can further comprise means for subdividing the stream into a plurality of sections of desired length in a first portion of the path upstream of the path portion where one or more detectors ascertain the density of the stream. Alternatively, at least one of the detectors can be placed downstream of the subdividing means, and such one detector can include means for weighing some or all of the sections and for generating signals which are indicative of the weight. This detector (weighing means) can be used in lieu of a detector which operates with a source of corpuscular radiation.

If one of the materials is water, each detector can be selected with a view to be responsive to the presence of water in a different way (e.g., one of the detectors ascertains and another detector fails to ascertain the presence of water). The processing means of such apparatus can include means for ascertaining the quantity of water in the stream. Analogously, if one of the materials is a plasticizer, each of the detectors can be designed to be responsive to the presence of plasticizer in a different way (e.g., one of the detectors records the presence of plasticizer but another detector does not), and the processing means then comprises means for ascertaining the quantity of plasticizer in the stream.

The measuring means can include a detector which directs X-rays across the stream.

The processing means can include means for generating signals denoting the quantity (dry weight) of fibrous material in the stream, and such apparatus can further comprise means for influencing the quantity (dry weight) of fibrous material in the stream as a function of the intensity and/or other characteristics of the second signals.

As mentioned above, the measuring means can comprise a plurality of detectors each of which is responsive to the presence of at least one of the materials in the stream in a different way and each of which generates different signals denoting the density of the stream. The processing means of such apparatus can comprise means for generating modified signals denoting the quantity of fibrous material in the stream, and means for regulating the quantity (dry weight) of fibrous material in the stream in response to the modified signals.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
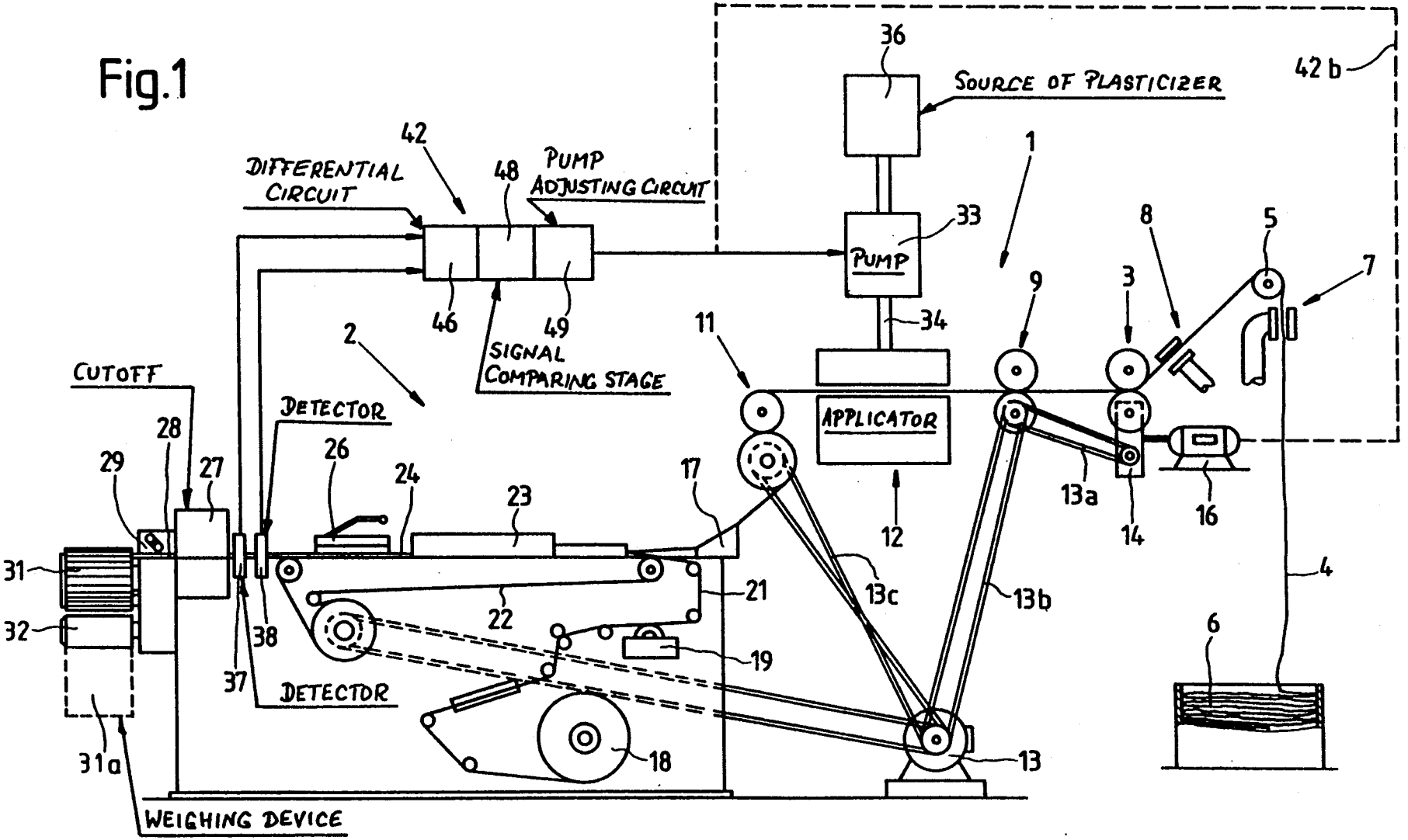
FIG. 1 is a schematic elevational view of a filter rod making machine including an apparatus which embodies one form of the present invention and serves to ascertain the percentage of plasticizer in filamentary filter material.

FIG. 1 shows a filter rod making machine which embodies the improved apparatus and wherein the apparatus serves to ascertain the percentage of plasticizer (such as triacetin) in a continuous filter rod 24 which further contains a tow 4 of filamentary filter material. The machine comprises a first main section 1 which includes means for forming a continuous composite unwrapped stream 4*a* of filter tow 4 and atomized plasticizer, and a second main section 2 which converts the stream 4*a* into the aforementioned rod 24 and includes means 27 for subdividing the rod 24 into filter rod sections 28 of desired length (e.g., of double unit length as customarily used in a filter tipping machine for cigarettes).

The section 1 comprises two driven advancing rolls 3 which draw the tow 4 from a bale 6 through a first opening or banding device 7, around a guide roll 5 and through a second opening or banding device 8. Each banding device comprises a nozzle which is connected to a source of compressed air and is located at one side of the path of movement of the tow 4, and a plate which is located opposite the nozzle at the other side of the path and causes the jets of compressed air to open or loosen the filaments of the tow. The rolls 3 are located ahead of a second pair of advancing rolls 9 which are driven at a higher peripheral speed so that the filaments of the tow 4 are stretched in the zone between the rolls 3 and 9. The tow 4 thereupon advances through a device 12 which sprays atomized plasticizer (such as triacetin) upon the loosened and tensioned filaments of the tow before successive increments of the tow enter the nip of two additional advancing rolls 11 upstream of a so-called gathering horn 17 wherein the stream 4*a* including the tow 4 and atomized plasticizer material is converted into a rod-like filler. One of the rolls 9 is preferably provided with circumferentially extending peripheral grooves and the other of these rolls has a smooth peripheral surface on a layer of elastomeric material. The same preferably applies for the rolls 11.

The lower roll 3 is driven by a variable-speed transmission 14 whose input element is driven by an endless belt conveyor 13*a* and whose ratio is regulatable by a variable-speed motor 16. The belt conveyor 13*a* receives motion from the lower roll 9 which is driven by a second belt conveyor 13*b* receiving motion from the output element of a main prime mover 13, e.g., a variable-speed electric motor. The output element of this motor further drives a belt conveyor 13*c* for the lower roll 11. It is clear that the single prime mover 13 can be replaced with two or three prime movers, e.g., one, for each of the three pairs of rolls 3, 9 and 11.

The ratio of the transmission 14 is regulatable in order to change the ratio of peripheral speed of the rolls 3 relative to the peripheral speed of the rolls 9 and to thus select the extent to which the filamentary material of the tow is stretched ahead of the applicator 12. It is possible to omit the transmission 14, the motor 16 and the belt conveyor 13*a* if the rolls 3 are provided with suitable braking devices which ensure that the peripheral speed of these rolls is less than that of the rolls 9.

The manner in which the applicator 12 spreads atomized plasticizer upon the loosened and stretched tow 4 of filamentary filter material to form the stream 4*a* is disclosed in numerous United States patents of the assignee of the present application. Reference may be had, for example, to the aforementioned U.S. Pat. No. 3,865,016 to Greve and to commonly owned U.S. Pat. No. 3,769,883 to Greve.

The horn 17 converts the stream 4*a* (tow 4 plus plasticizer) into a rod-like filler which is thereupon draped into a web 21 of suitable wrapping material supplied by a reel 18. One side of the running web 21 is coated with adhesive during travel past a suitable paster 19, and the draping operation is carried out on the upper reach or stretch of an endless belt conveyor 22 known as garniture in cooperation with a conventional wrapping mechanism 23. The conveyor 22 cooperates with the pairs of rolls 3, 9 and 11 to define for the tow 4, stream 4*a*, filter rod 24 and filter rod sections 28 an elongated path. The rod 24 issues from the wrapping mechanism 23 and the seam which is formed by the overlapping marginal portions of the draped web 21 is heated or cooled (depending on the nature of adhesive which is applied by the paster 19) by a so-called sealer 26 in order to reinforce the tubular envelope of the rod 24 prior to entry of successive increments of the rod into the cutoff 27 wherein the rod 24 is subdivided into a file of filter rod sections 28. Such sections are propelled by a rapidly rotating accelerating cam 29 which causes them to enter successive axially parallel peripheral flutes of a rotary drum-shaped conveyor 31. The latter deposits a row of parallel filter rod sections 28 onto the upper reach of an endless belt conveyor 32 with which the filter rod sections move sideways into the magazine of a filter tipping machine or to storage.

The applicator 12 receives a continuous flow of liquefied or liquid plasticizer from a suitable source 36 by way of a variable-delivery pump 33 having an outlet 34.

Figure 2:
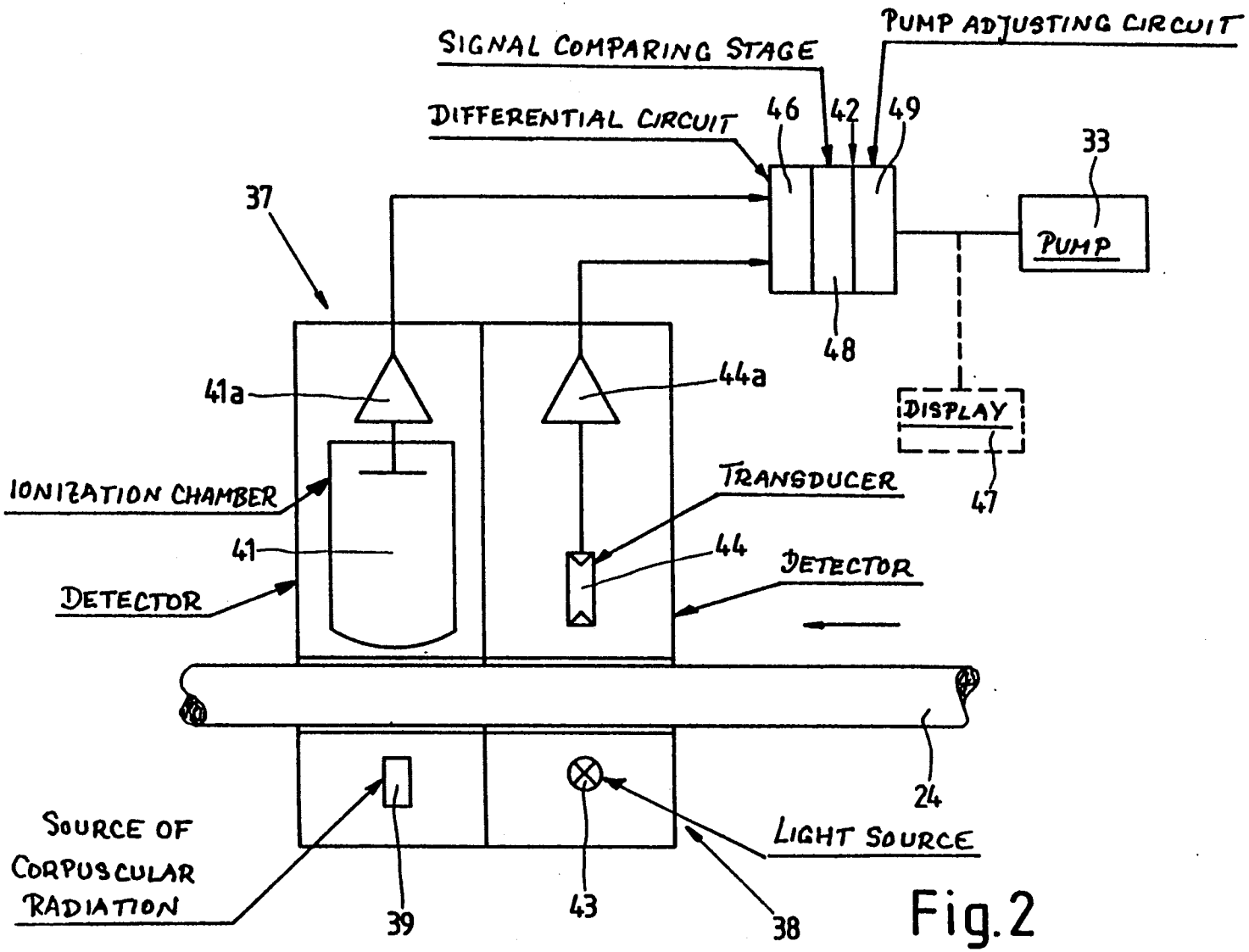
FIG. 2 is an enlarged view of a detail in the apparatus of FIG. 1, showing two detectors which serve to monitor the density of successive increments of the stream of filter tow and plasticizer in different ways.

The improved apparatus can be said to include the aforediscussed means 1 for forming the stream 4*a*, the aforediscussed means 22 for advancing or conveying the stream 4*a* along an elongated path, and a measuring arrangement which serves to ascertain the density of the stream 4*a* and includes means for generating signals denoting the monitored density. Such signals are transmitted to a processing circuit 42 which generates modified signals serving to adjust the pump 33 through the medium of a regulating or adjusting circuit 49. In the apparatus of FIGS. 1 and 2, the measuring arrangement comprises two discrete detectors 37, 38 which are adjacent the path of movement of the rod 24 (draped stream 4*a*) between the sealer 26 and the cutoff 27, i.e., upstream of the location where the rod 24 is converted into a file of discrete filter rod sections 28. In accordance with a feature of the invention, the detectors 37 and 38 are designed in such a way that each thereof reacts differently to the presence of plasticizer in the stream 4*a*, namely each of these detectors measures the density of successive increments of the filler in the wrapper of the rod 24 in a different way.

FIG. 2 shows that the first detector 37 includes a source 39 of corpuscular radiation (e.g., beta rays) which is directed against the rod 24 in the adjacent portion of the path for the stream 4*a*. The intensity and/or other characteristics of radiation which has passed through the rod 24 are ascertained by an ionization chamber 41 which transmits appropriate signals to an amplifier 41*a* for amplification and transmission to the corresponding input of the processing circuit 42, namely to one input of a differential circuit 46. The detector 37 transmits signals which are indicative of the quantity of filamentary filter material (tow 4) as well as of the quantity of plasticizer. Thus, the signals which are transmitted by the output of the amplifier 41*a* are indicative of the sum of quantities of filamentary filter material and plasticizer (second material) in the corresponding increments of the stream 4*a*.

The second detector 38 is an optical detector wherein a source 43 of infrared light directs a beam of such radiation across the respective portion of the path for the stream 4*a*, and the intensity and/or another characteristic of light which has passed through the stream 4*a* is ascertained by a photoelectronic transducer 44 for infrared light whose output transmits appropriate signals to an amplifier 44*a*. This amplifier is connected to the second input of the differential circuit 46. The intensity of radiation which has penetrated through the stream 4*a* and has reached the transducer 44 is not influenced by the plasticizer so that the signals which are transmitted by the output of the amplifier 44*a* are indicative solely of the density of the tow 4 in successive increments of the stream 4*a*.

The output of the circuit 46 transmits a signal which is indicative solely of the quantity of plasticizer in successive increments of the stream 4*a*, and such (modified) signal is transmitted to a signal comparing stage 48 wherein the modified signal is compared with a reference signal denoting the desired percentage of plasticizer per unit length of the stream 4*a*. If the characteristics of the modified signal deviate from the characteristics of the reference signal, the stage 48 transmits a signal to the adjusting circuit 49 which adjusts the pump 33 in a sense to increase or reduce the rate of admission of plasticizer from the source 36 to the applicator 12. The modified signal can denote the percentage of plasticizer per unit length of the stream 4*a* or the actual quantity per unit length. FIG. 2 shows by broken lines a display unit 47 which is connected with the output of the adjusting circuit 49 and can be observed by an attendant to manually adjust the pump 33, if and when necessary. It is preferred to use signals from the stage 48 of the processing or evaluating circuit 42 for automatic regulation of operation of the pump 33.

The measuring arrangement including the detectors 37 and 38 enables the processing circuit 42 to regulate the percentage of plasticizer per unit length of the stream 4*a* with a high degree of accuracy and reliability. Such regulation takes place while the machine embodying the improved apparatus is operated at full speed. All that is necessary is to carry out several density measurements with different results which enable the evaluating circuit 42 to generate and transmit signals suitable for appropriate adjustment of the rate of admission of plasticizer and for maintaining the percentage of plasticizer in the stream 4*a* within a desired range, e.g., at a fixed value.

The apparatus of FIGS. 1 and 2 can be modified in a number of ways without departing from the spirit of the invention. For example, the detector 37 and/or 38 can be placed adjacent the path of the stream 4*a* downstream of the cutoff 27 so that it monitors the density of one or both materials of the stream upon subdivision of the stream into sections of desired length. The construction and mode of operation of the evaluating circuit 42 are not affected, or are not appreciably affected, by transposition of one or both detectors downstream of the cutoff 27.

It is equally possible to replace the detector 37 with a detector which contains a source of visible light or a source of ultraviolet light. This merely necessitates the selection of a somewhat different transducer.

Furthermore, the means for measuring the density of the stream 4*a* can comprise three or even more detectors, for example, if it is desirable or necessary to ascertain the percentage of plasticizer with an even higher degree of accuracy.

Still further, and referring again to FIG. 2, the detector 38 with a single light source 43 and a single transducer 44 opposite the light source 43 can be used in conjunction with one or more additional photoelectric detectors. A single light source and a single transducer will normally suffice for adequate monitoring of a filter rod. However, and as shown for example in commonly owned U.S. Pat. No. 4,645,921 in connection with optical scanning of a travelling cigarette rod, it is equally possible to employ two or more pairs of light sources and associated transducers in order to further enhance the accuracy of density measurement by the respective detector. Two or more light sources and transducers can surround the rod 24 in one and the same portion of the path, or they can be staggered with reference to each other not only in the circumferential but also in the axial direction of the rod. The transmission of signals from different transducers is then regulated as to time so as to ensure that the corresponding input of the circuit 46 receives simultaneously all those signals which are generated as a result of monitoring of one and the same portion of the stream 4*a*.

The improved method and apparatus can be used with equal or similar advantage to ascertain the percentage of other materials in streams which contain fibrous material. By way of example, the method and apparatus can be used to ascertain the percentage of water in (i.e., the moisture content of) a stream of natural, reconstituted and/or artificial tobacco. Such determination can be made prior or subsequent to draping of tobacco into a web of cigarette paper or the like or in part prior to and in part after draping. For example, and referring to FIG. 1 of commonly owned U.S. Pat. No. 4,538,626 to Hinzmann, the single density monitoring device 43 in front of the cutoff which divides a continuous cigarette rod into a file of plain cigarettes can be replaced with the detectors 37, 38 of the measuring means shown in FIG. 1 of the present application. The detector 37 then ascertains the combined quantity of tobacco particles and water per unit length of the wrapped stream of the running cigarette rod while the detector 38 merely ascertains the quantity of fibrous material (tobacco). The processing circuit 42 is then used to first generate modified signals which denote the quantity of water per unit length of the cigarette rod and transmit modified signals to a display unit and/or to an adjustable means for influencing the quantity of water in the tobacco stream, i.e., to an equivalent of the influencing means (pump) 33 in the machine which is shown in FIG. 1 of the present application. Accurate determination of the moisture content of a tobacco stream is important for a number of reasons. For example, it is desirable to shred tobacco leaf laminae while their moisture content equals or closely approximates a fixed value.

Referring again to FIG. 1 of U.S. Pat. No. 4,538,626 to Hinzmann, the detector 37 can be installed immediately upstream of the cutoff and the detector 38 can be installed downstream of the cutoff to ascertain the density of tobacco in successive plain cigarettes. Alternatively, the detector 37 can be placed immediately upstream of the cutoff while the detector 38 is mounted adjacent the trimming device which removes the surplus from the stream ahead of the draping station. In other words (and this applies also for the apparatus of the present invention), the detectors 37 and 38 need not be placed next or close to each other; in fact, and as explained above, one of the detectors can monitor the quantity of one or both materials in the wrapped stream while another detector monitors the quantity of one or both materials per unit length of the undraped stream.

A third detector of the measuring arrangement can be used to direct X-rays across the path of the stream of tobacco or fibrous filter material. Alternatively, such detector can be used in lieu of one of the detectors 37, 38.

Referring again to FIG. 1, the conveyor 32 can constitute or form part of a weighing device 60 which can be used in addition to or in lieu of the detector 37. It is well known that the density of a fibrous material is directly proportional to its weight or mass. Therefore, the weighing device 60 can be used to ascertain the weight or mass of some or all of the filter rod sections 28 downstream of the cutoff 27. Signals which are generated by such weighing device are indicative of the density and quantity of all materials in the respective sections 28, i.e., of the density of the respective lengths of the tow 4 as well as of the quantity of plasticizer in the tow. In other words, the measurements which are carried out with the weighing device 60 are equivalent to those which are carried out with the detector 37; therefore, the weighing device 60 can be used in the measuring means of the improved apparatus in lieu of the detector 37 or in addition to such detector (e.g., to monitor the accuracy of measurements which are carried out by the detector 37).

If the weighing device 60 is used in lieu of the detector 37, the processing or evaluating circuit receives signals from the device 60 and from the detector 38, and the circuit 49 again receives modified signals which denote the quantity of plasticizer per unit length of the stream 4*a*. Such signals are used to adjust the pump 33 in order to maintain the percentage of plasticizer within a desired range.

The weighing device 60 need not be installed in the machine of FIG. 1, i.e., it is equally possible to install this device in the machine which receives filter rod sections 28 from the conveyor 32. This also applies for measurements which are carried out by the detector 37, i.e., the detector 37 can also monitor discrete sections of the stream 4*a* downstream of the cutoff 27. For example, the detectors 37, 38 or the detectors 37, 38, 60 or the detectors 38, 60 can be installed in a separate housing which is adjacent a portion of the path of movement of sections 28 downstream of the cutoff 27.

The situation is analogous if the improved apparatus is used to monitor several materials in a stream wherein the fibrous material is natural, reconstituted and/or artificial tobacco. The weighing device 60 can be used in lieu of the detector 37 to ascertain the combined quantity of all materials in successive increments of a continuous tobacco-containing stream or in discrete sections of a subdivided tobacco-containing stream, and such weighing device is used with the detector 38 or with an analogous detector to ascertain the moisture content of successive increments or unit lengths of the stream.

A weighing device which can be used in the apparatus of the present invention is disclosed in commonly owned British Pat. No. 1,085,684: Reference may also be commonly owned U.S. Pat. No. 3,429,317 to Koch et al.

A measuring arrangement which employs a detector 37 operating with corpuscular radiation and a detector 38 operating with infrared light is preferred in many instances because it has been ascertained that light (including infrared, visible and ultraviolet light) which penetrates across a running stream of moisture-containing fibrous material (such as the plasticizer-containing tow 4 or a stream of tobacco particles which contain water) is not affected by the liquid constituent(s) of the stream or is affected only to a negligible degree. Consequently, light which has penetrated across the stream is indicative solely of the mass of fibrous material of the stream so that the corresponding signals can be readily processed with signals from the detector 37 to furnish modified signals which are indicative of the percentage of liquid in the stream. As mentioned above, the placing of several detectors next to each other is often preferred but is not absolutely necessary since a detector (for example, the detector 38) which is placed downstream of the cutoff 27 will operate just as satisfactorily and its signals will be just as reliable.

FIG. 1 further shows by broken lines a connection 42*b* between an output of the adjusting circuit 49 and the variable-speed motor 16. This connection serves to change the speed of the motor 16 (or to operate the motor 16 for a given interval of time), and to thus change the ratio of the transmission 14, when the dry weight of the fibrous material (tow 4) in the filter rod 24 deviates from a desired value. The transmission 14 then increases or reduces the speed of the rolls 3 to thereby alter the extent to which the filaments of the tow 4 are stretched between the rolls 3 and 9. This results in a change of the dry weight of fibrous material per unit length of the filler in the filter rod 24. The same or a similar result can be achieved by simply changing the speed of withdrawal of the tow 4 from the bale 6. All that counts is to ensure that the dry weight of fibrous filter material per unit length of the filler 4*a* in the rod 24 can be regulated in response to signals which are generated by the processing circuit 42 when the filter rod making machine is in use. The processing circuit 42 monitors the quantity of fibrous material per unit length of the rod 24 and compares such quantity with a reference value. The connection 42*b* transmits a signal to adjust or to operate the motor 16 when the monitored quantity of fibrous material (i.e., the dry weight of fibrous material) deviates from the reference value.

Figure 3:
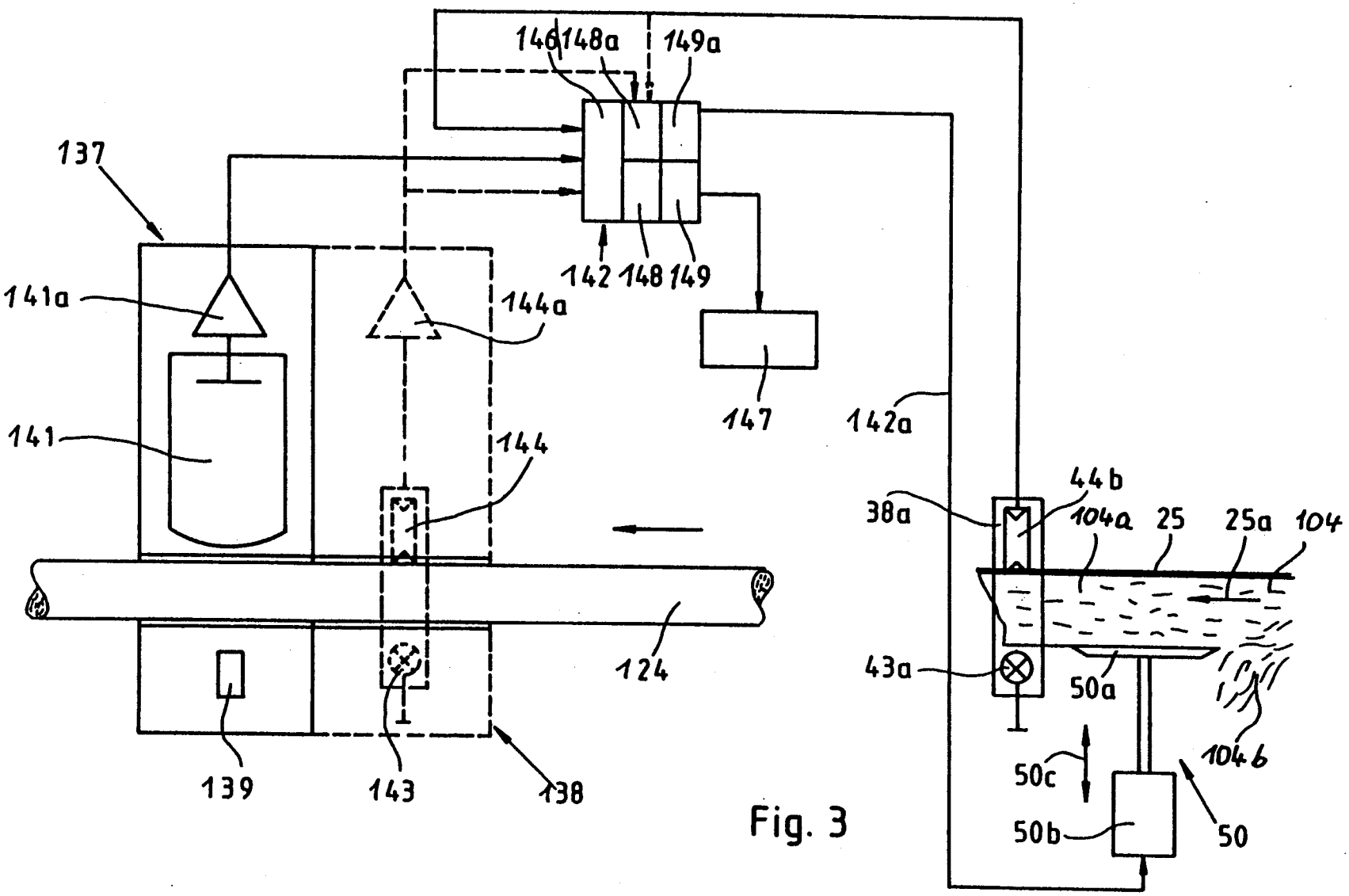
FIG. 3 is a view similar to that of FIG. 2 but showing a portion of a cigarette making machine with means for ascertaining the dry weight of tobacco in the filler of the cigarette rod.

FIG. 3 shows a portion of a cigarette rod making machine wherein the rod 124 is a continuous cigarette rod which is to be subdivided into plain cigarettes of unit length or multiple unit length, e.g., in a manner as disclosed in U.S. Pat. No. 4,538,626 to Hinzmann. The filler 104*a* of this rod is obtained by removing the surplus 104*b* from a stream 104 of fibrous material (such as natural, substitute or reconstituted tobacco) which is transported by a conveyor 25 in the direction of arrow 25*a* and is trimmed by an equalizing device 50 whose material removing elements 50*a* (one shown) are movable up and down (note the double-headed arrow 50*c*) by a reversible servomotor 50*b* receiving signals via conductor means 142*a* from an output of an adjusting circuit 149*a* forming part of a processing circuit 142.

A differenctial circuit 146 of the processing circuit 142 receives signals from a detector 137 which is or can be identical with the detector 37 of FIG. 2 and serves to ascertain the quantity of fibrous material in successive increments of the filler 104*a* plus the quantity of moisture in such increments. The detector 38 of FIG. 2 is replaced with a detector 38*a* which is adjacent the path of movement of the filler 104*a* and ascertains the quantity of tobacco in successive unit lengths of the filler 104*a*. To this end, the detector 38*a* includes a radiation source 43*a* which emits infrared radiation in the range of approximately 950 to approximately or even beyond 1700 nm. A transducer 44*b* of the detector 38*a* generates signals in response to radiation which penetrates through successive increments of the filler 104*a*, and such signals are indicative of the quantity (dry weight) of fibrous material because radiation within the aforementioned range is not influenced by the moisture in the filler 104*a*.

The transducer 44*b* transmits signals to the differential circuit 146 of the processing circuit 142, and the differential circuit compares such signals with a reference signal denoting the desired dry weight of the filler 104*a* and, when necessary, causes an adjusting circuit 149*a* to transmit a signal to the motor 50*b* so as to raise or lower the material removing elements 50*a*, i.e., to increase or reduce the quantity of fibrous material in the filler 104*a*.

The detector 137 of FIG. 3 transmits signals which are indicative of the combined quantity of fibrous material and moisture, and the differential circuit 146 compares such signals with signals from the transducer 44*b*. The circuit 146 generates signals constituting the differences or the quotients of the incoming signals and hence the moisture content of successive increments of the cigarette rod 124. Such signals are displayed at 147.

The detector 137 (whose parts 139, 141, 141*a* are identical with the similarly referenced parts of the detector 37) can be replaced with a weighing device, such as the weighing device 60 of FIG. 1.

FIG. 3 further shows, by broken lines, a detector 138 which can be used in lieu of or in addition to the detector 38*a* in order to allow for calculation of dry weight of successive increments of the filler 104*a* and to enable the display unit 147 to furnish information denoting the moisture content of unit lengths of the filler. The parts 143, 144, 144*a* of the detector 138 are identical with the similarly referenced parts of the detector 38. The difference signal which is transmitted by the circuit 146 to a signal comparing stage 148 of the processing circuit 142 is compared with a reference signal denoting the desired moisture content of unit lengths of the filler 104*a*, and the thus obtained signal is transmitted by a further circuit 149 whose output is connected to the display unit 147. If desired or necessary, the signal at the output of the circuit 149 can be used to vary the moisture content of fibrous material in the stream 104 or in the source which supplies the fibrous material to form the stream 104.

The signal which is transmitted by the differential circuit 146 can be processed to denote the dry weight of tobacco in the filler 104*a*, the same as the signal from the transducer 44*b*. To this, end, the signal which is transmitted by the circuit 146 is applied to the input of a comparator 148*a* of the processing circuit 142 wherein the signal is compared with a reference signal indicative of the desired quantity (dry weight) of tobacco per unit length of the filler 104*a*. If the dry weight is unsatisfactory, the adjusting circuit 149*a* causes the motor 50*b* to raise or lower the material removing elements 50*a* of the equalizing device 50.

If desired, signals which are generated as a result of processing of signals from the detectors 137, 138 can be used to monitor the accuracy of signals, from the transducer 44*b* or vice versa, i.e., to compare the dry weight as detected by 38*a* with the dry weight as detected by 138 in conjunction with 137.

An important advantage of the improved method and apparatus is that the quantity of liquid ingredient of the stream can be ascertained while the machine which embodies the apparatus is operated at full speed. This is particularly important in recent types of cigarette rod making and filter rod making machines which turn out large quantities of rod-shaped articles per unit of time so that any, even shortlasting, interruption of operation or slowdown would entail huge losses in output. The method can be carried out without removing any samples from the path of the stream.

Another important advantage of the improved method and apparatus is the surprisingly high degree of accuracy with which the percentage of plasticizer or water can be determined while the machine is operated at full speed. Moreover, modified signals which are generated by the processing circuit 42 or 142 or an equivalent circuit can be used for immediate and automatic regulation of the percentage of a selected material in the stream so that the quality of rod-shaped articles which are obtained from the stream is highly satisfactory and the number of rejects is small.

A further important advantage of the improved method and apparatus is that they allow for accurate and automatic determination of the dry weight of unit lengths of the rod 24 or 124, either by relying on a single detector (38*a*) or by relying on a combination of two detectors (138 and 139).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making rod-like products of the tobacco processing industry, comprising forming a composite stream containing a fibrous material and a second material; conveying the stream along a predetermined path; a first measuring step including measuring the density of successive increments of the stream by directing radiation across the stream in at least one portion of said path, monitoring the characteristics of radiation which passes through the stream and generating first signals denoting the density of the stream; a second measuring step including measuring the density of successive increments of the stream in a manner different from that in accordance with said first measuring step and generating second signals denoting the thus measured density; and processing the first and the corresponding second signals to ascertain the quantity of at least one said materials in the stream.

2. The method of claim 1, wherein said processing step comprises converting said first and the corresponding second signals into modified signals denoting the quantity of said at least one material in the stream, said modified signals being indicative of the differences between the intensities and/or other characteristics of said first and the corresponding second signals.

3. The method of claim 1, wherein said second material is or contains a liquid.

4. The method of claim 1, further comprising the step of utilizing the processed signals to regulate the quantity of at least one of said materials in the stream so as to maintain the percentage of the at least one material within a predetermined range.

5. The method of claim 1, wherein said radiation is corpuscular radiation.

6. The method of claim 1, wherein said radiation is light.

7. The method of claim 6, wherein said light is infrared light.

8. The method of claim 1, further comprising the step of subdividing the stream into sections of predetermined length in a second portion of said path upstream of said at least one portion.

9. The method of claim 8, wherein said second measuring step comprises weighing the sections and said second signals denote the weight of such sections.

10. The method of claim 1, wherein said radiation includes X-rays.

11. The method of claim 1, wherein the first material is filter tow and the second material is a plasticizer and said processing step comprises comparing said first and the corresponding second signals and generating third signals denoting the quantity of plasticizer in the stream.

12. The method of claim 1, wherein the second material is water and said processing step comprises comparing said first and the corresponding second signals and generating third signals denoting the quantity of water in the stream.

13. The method of claim 1, wherein said processing step includes ascertaining the dry weight of the fibrous material, and further comprising the step of regulating the dry weight of fibrous material as a function of the intensities and/or other characteristics of said signals.

14. The method of claim 1, wherein said processing step comprises converting said first and the corresponding second signals into reference signals denoting the quantity of fibrous material in the stream and further comprising the step of regulating the quantity of fibrous material in the stream as a function of said reference signals.

15. Apparatus for making rod-like products of the tobacco processing industry, comprising means for forming a composite stream containing fibrous material and a second material; means for conveying the stream along a predetermined path; first measuring means for measuring the density of the stream, including means for generating first signals denoting the density; second measuring means for measuring the density of the stream in a manner different from density measurement by said first measuring means, including means for generating second signals denoting the thus measured density; and means for processing said first and second signals to ascertain the quantity of at least one of said materials in the stream.

16. The apparatus of claim 15, wherein each of said signal generating means comprises a detector, each of said detectors being responsive to the presence of at least one of said materials in the stream in a different way and having means for generating the respective signal.

17. The apparatus of claim 16, wherein said processing means includes means for evaluating said first and second signals.

18. The apparatus of claim 17, wherein said evaluating means comprises means for generating modified signals denoting the differences between said first and second signals.

19. The apparatus of claim 18, wherein said forming means includes adjustable means for influencing the quantity of at least one of said materials in the stream, and further comprising means for adjusting said influencing means in response to said modified signals so as to maintain the percentage of the one material in the stream within a predetermined range.

20. The apparatus of claim 16, wherein one of said detectors includes means for directing a beam of corpuscular radiation across the stream in a predetermined portion of said path, and means for monitoring the characteristics of radiation which has penetrated across the stream.

21. The apparatus of claim 16, wherein one of said detectors includes means for directing a beam of light across the stream in a predetermined portion of said path and means for monitoring the characteristics of light which has penetrated across the stream.

22. The apparatus of claim 21, wherein said directing means includes a source of infrared light.

23. The apparatus of claim 16, further comprising means for subdividing the stream into a plurality of sections of predetermined length in a first portion of said path, at least one of said detectors being adjacent a second portion of said path downstream of said first portion.

24. The apparatus of claim 23, wherein said one detector includes a device for weighing the sections of the subdivided stream.

25. The apparatus of claim 16, wherein one of the materials in the stream is water and each of said detectors is responsive to the presence of water in the stream in a different way, said processing means including means ascertaining the quantity of water in the stream.

26. The apparatus of claim 16, wherein one of the materials in the stream is a plasticizer and each of said detectors is responsive to the presence of plasticizer in a different way, said processing means including means for ascertaining the quantity of plasticizer in the stream.

27. The apparatus of claim 15, wherein one of said said measuring means includes means for directing X-rays across the stream in a predetermined portion of said path.

28. The apparatus of claim 15, wherein said processing means includes means for generating additional signals denoting the quantity of fibrous material in the stream, and further comprising means for influencing the quantity of fibrous material in the stream as a function of the intensity and/or other characteristics of said additional signals.

29. The apparatus of claim 15, wherein each of said signal generating means comprises a detector, each of said detectors being responsive to the presence of at least one of said materials in the stream in a different way, said processing means including means for generating modified signals denoting the quantity of fibrous material in the stream and further comprising means for regulating the quantity of fibrous material in the stream in response to said modified signals.

* * * * *